US009310058B2

(12) United States Patent
Romeu et al.

(10) Patent No.: US 9,310,058 B2
(45) Date of Patent: Apr. 12, 2016

(54) LAMP CONNECTOR

(71) Applicant: LIGHTING SCIENCE GROUP CORPORATION, Satellite Beach, FL (US)

(72) Inventors: Ricardo Romeu, Melbourne, FL (US); Mark Penley Boomgaarden, Satellite Beach, FL (US); Eric Holland, Indian Harbour Beach, FL (US)

(73) Assignee: Lighting Science Group Corporation, Melbourne, FL (US)

( * ) Notice: Subject to any disclaimer, the term of this patent is extended or adjusted under 35 U.S.C. 154(b) by 245 days.

(21) Appl. No.: 14/176,542

(22) Filed: Feb. 10, 2014

(65) Prior Publication Data

US 2015/0226410 A1 Aug. 13, 2015

(51) Int. Cl.

| | |
|---|---|
| ***F21V 21/00*** | (2006.01) |
| ***F21V 21/116*** | (2006.01) |
| ***F21S 8/08*** | (2006.01) |
| *F21Y 101/02* | (2006.01) |
| *F21W 131/103* | (2006.01) |

(52) U.S. Cl.

CPC ..... *F21V 21/116* (2013.01); *F21S 8/085* (2013.01); *F21W 2131/103* (2013.01); *F21Y 2101/02* (2013.01)

(58) Field of Classification Search

CPC ..... F21V 21/002; F21V 21/26; F21V 21/28; F21V 21/29; F21V 21/30; F21V 21/116; F21V 23/06

See application file for complete search history.

(56) References Cited

U.S. PATENT DOCUMENTS

| | | | | |
|---|---|---|---|---|
| 2010/0309673 | A1* | 12/2010 | Liu | F21S 8/086 362/427 |
| 2011/0122634 | A1* | 5/2011 | Liu | F21V 21/116 362/427 |
| 2014/0197291 | A1* | 7/2014 | Schultz | F21V 21/116 248/226.11 |

* cited by examiner

*Primary Examiner* — Andrew Coughlin

(74) *Attorney, Agent, or Firm* — Mark Malek; Stephen Bullock; Widerman Malek, PL

(57) ABSTRACT

A lamp connector may include a base member, a top member and connector members that connect the base member to the top member. The base member may include arcuate passageways in a bottom portion and a first and second pair of opposing sidewall members that extend upwardly from the bottom portion. The top portion of each of the first pair and second pair of opposing sidewall members may have a cutaway portion having a radius. The radius of the cutaway portion of the first pair of opposing sidewalls may be different from the radius of the second pair of opposing sidewalls. The cutaway portion may be formed to fit a lamp connecting member. The base member may be selectively rotatable with respect to the top member so as to enable engagement between one of the first pair of sidewalls and the second pair of sidewalls with the lamp connecting member.

18 Claims, 5 Drawing Sheets

LAMP CONNECTOR

FIELD OF THE INVENTION

The present invention relates to the field of lighting and, more specifically, to the field of lamp connectors to be used in connection with lighting devices.

BACKGROUND OF THE INVENTION

A street light, lamppost or street lamp, is a raised source of light on the edge of a road or walkway, which emits light at a certain time every night. Street lights are utilized to illuminate signs and hazards that may be outside of the reach of headlights. Darkness and poorly illuminated roads are a known cause for many motor vehicular accidents and fatalities. Pedestrian fatalities are much more likely in the dark than in daylight. Additionally, lighted intersections and highway interchanges tend to have fewer auto accidents than unlighted intersections and interchanges.

Street lamps are typically mounted on a pole. Various poles, however, may vary in circumference. For example, installation poles may be 4", 5" or 6" circumference poles. Street lamp poles may also have a square shape or a circular shape. Tapered poles also vary in diameter and the diameter may range for example from 3.5" to 3.8". This creates a problem because the lamp is typically manufactured independently before being connected to the pole.

The varying specifications of a lamp pole or post are problematic because a lamp is not typically tailored to fit a particular pole. Installation can become a cumbersome process because the pole may not fit the lamp attachment with the precision that may be necessary to ensure a secure connection. The lamp installation may continue by either modifying the pole or the lamp attachment, which may both be unenviable options. Manufacturing a lamp connection may be expensive and difficult to install. Connecting a lamp pole via an unwieldy lamp connection is also very labor intensive.

US. Publication No. 2013/0039040 by Park discloses an LED street lamp device. In this disclosure, the LED streetlamp device may be attached and installed to a connecting bar of a lamppost by coupling a fastening portion using a general coupling member formed of one of a bolt, a nut, and a bracket. However construction and assembly of the many separate components listed above may add to design complexity and cost for the disclosed streetlamp.

US Publication No. 2011/0233568 by An et al. (hereafter referred to as An) also discloses an LED street lamp. FIG. 7 of An illustrates LED modules 140 in a case 120 connected to a lamppost 110. This disclosure illustrated another form of the problem, where an LED lighting device is manufactured to fit a single lamppost. The LED lighting devices disclosed in An require different design specifications for each type of lamppost for the LED case 120 so that the LED modules may be attached to a lamppost. It can be an expensive process to produce additional designs and produce LED cases that can only fit a single lamppost.

Accordingly, a need exists for a connection that is user friendly, and enables a lamp to be attached to lamp poles of different dimensions securely. This background information is provided to reveal information believed by the Applicant to be of possible relevance to the present invention. No admission is necessarily intended, nor should it be construed, that any of the preceding information constitutes prior art against the present invention.

SUMMARY OF THE INVENTION

With the foregoing in mind, the present invention is related to a lamp connector to be used in connection with connecting a lamp to a lamp connecting member. More specifically, the lamp connector according to embodiments of the present invention may advantageously connect to number of different sized lamp posts so as to prevent manufacturing delays associated with sizing a lamp to a particular lamp pole. The lamp connector according to embodiments of the present invention may advantageously allow for simplified installation of a lamp to a connecting member such as, for example, a light pole, lamppost, or another structure adapted to receive a lamp. The lamp connector may advantageously include various fittings to allow for a lamp to be readily installed on any type of lamp connecting members. Further, the lamp connector according to embodiments of the present invention may advantageously provide simplified installation of a lamp, thereby reducing labor costs. The lamp connector according to embodiments of the present invention may further advantageously provide enhanced stability to a lamp installed on a lamp connector of a light pole. The lamp connector according to embodiments of the present invention may also advantageously provide various fittings to accommodate poles having different circumferences.

These and other objects, features and advantages according to the present invention are provided by a lamp connector that may include a base member, a top member and connector members having portions connected to each of the base member and the top member to connect the base member and the top member to one another. The base member may include a bottom portion having arcuate passageways formed therein, a first pair of opposing sidewall members that extend upwardly from the bottom portion, and a second pair of opposing sidewall members that also extend upwardly from the bottom portion. The top portion of each of the first pair of opposing sidewall members may have a first cutaway portion having a first radius. The top portion of each of the second pair of opposing sidewall members may have a second cutaway portion having a second radius. The first radius and the second radius may be different. The cutaway portion of each of the first pair and the second pair of opposing sidewalls may be formed to fit the diameter of a lamp connecting member. The base member may be selectively rotatable with respect to the top member so as to enable engagement between one of the first pair of sidewalls and the second pair of sidewalls with the lamp connecting member.

The top member of the lamp connector may include passageways formed therein to receive the connector member. The connector members may be a pair of connector members. The arcuate passageways may be a pair of arcuate passageways, and the pair of connector members may engage the pair of arcuate passageways to secure the lamp connecting member between the base member and the top member. The arcuate passageways of the base member may be symmetrically formed, and may also be threaded.

The connector members may, for example, be provided by bolts and may be movable between a detached position and an attached position. The detached position may be defined as allowing the base member to rotate with respect to the lamp connecting member. The attached position may be defined as the cutaway portion of at least one of the first and second pair of opposing sidewalls being tightened to the lamp connecting member.

The base member and the first and second opposing sidewalls may be integrally formed as a monolithic unit. Alternatively, the first and second opposing walls may, for example, be welded to the base member. The top member may include a movement restriction member that has an L-shaped portion which may be positioned to restrict movement of the lamp connecting member.

The details of one or more embodiments of the invention are set forth in the accompanying drawings and the description below. Other features, objects and advantages of the invention will be apparent from the description and drawings, and from the claims.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

Additionally, in the following detailed description, reference may be made to the driving of light-emitting diodes, or LEDs. A person of skill in the art will appreciate that the use of LEDs within this disclosure is not intended to be limited to the any specific form of LEDs, and should be read to apply to light emitting semiconductors in general. Accordingly, skilled artisans should not view the following disclosure as limited to the any particular light emitting semiconductor device, and should read the following disclosure broadly with respect to the same. Those skilled in the art will also appreciate that the terms luminaire and lighting device are interchangeably used throughout this disclosure and are meant to refer to the same structural items.

Figure 1:
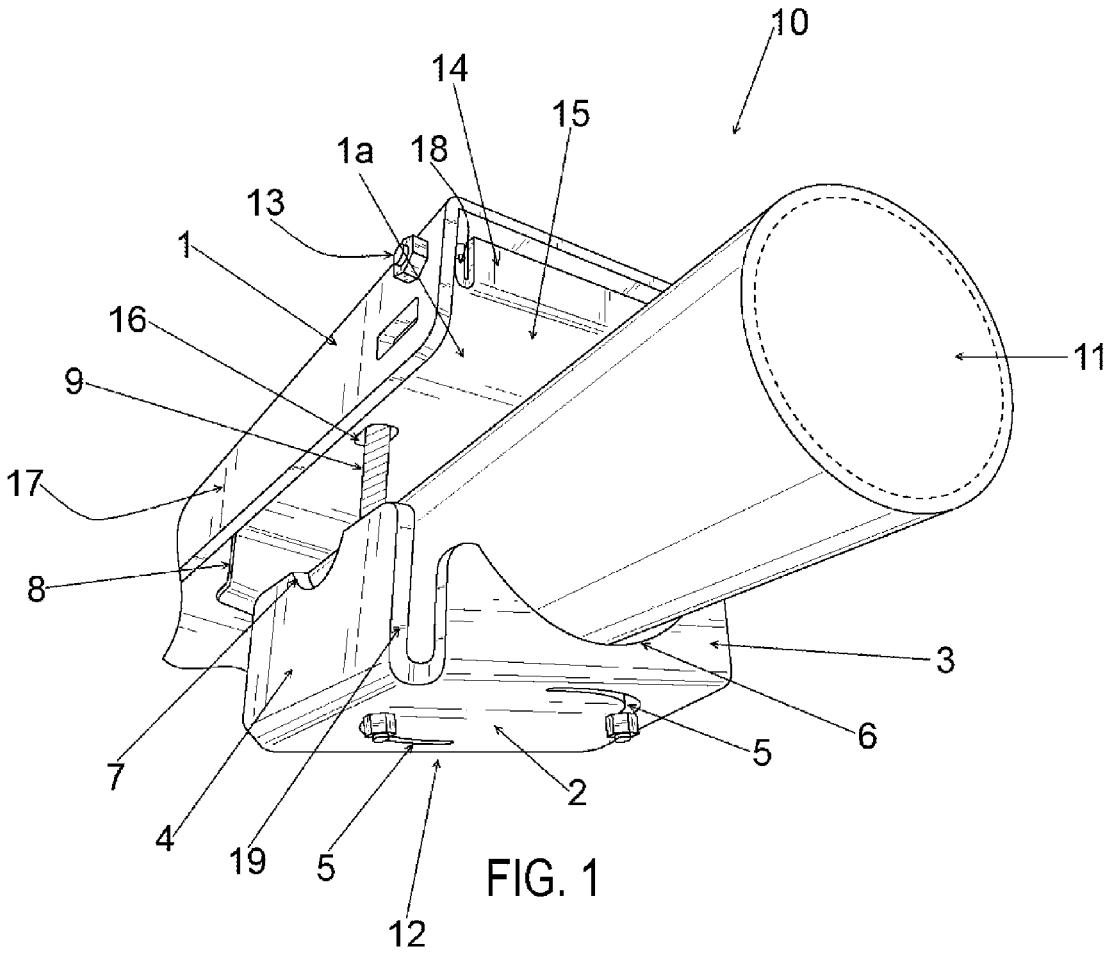
FIG. 1 is a perspective view of a lamp connector according to an embodiment of the present invention fitted with a lamp connecting member.
Figure 2:
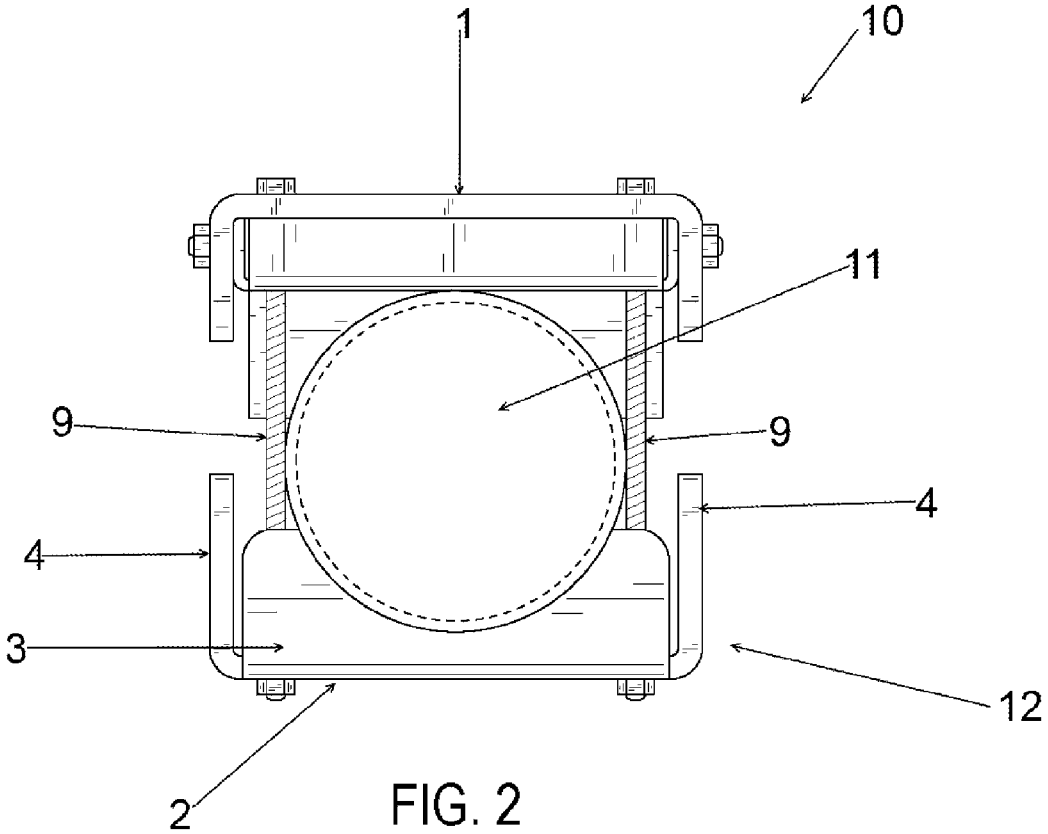
FIG. 2 is a rear elevation view of the lamp connector illustrated in FIG. 1.
Figure 3:
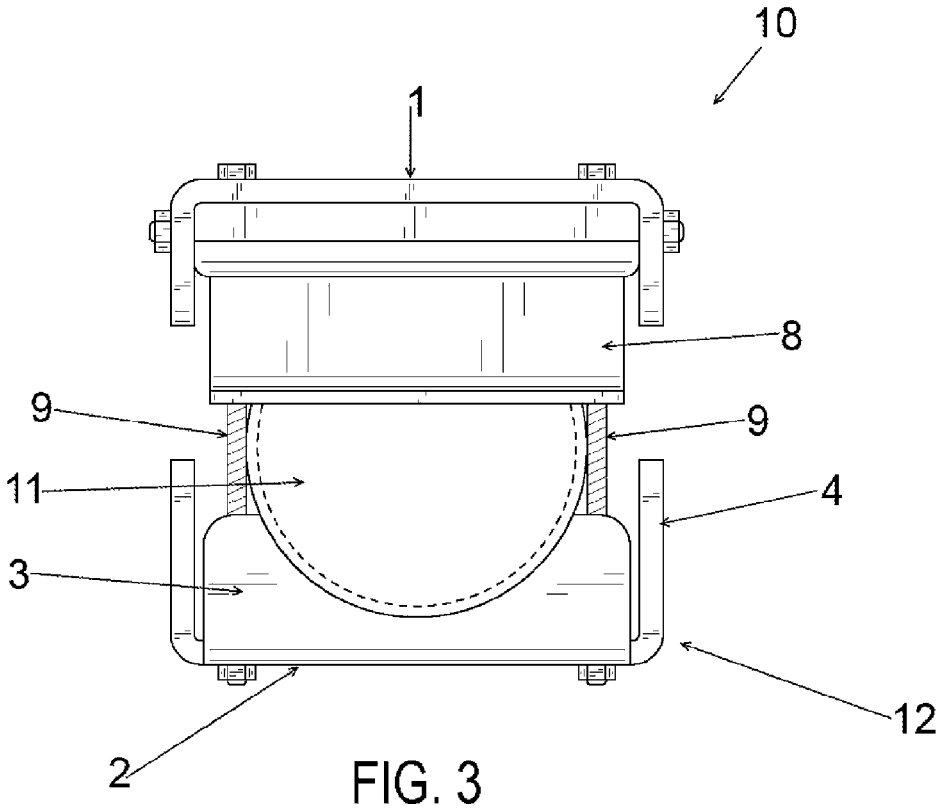
FIG. 3 is a front elevation view of the lamp connector illustrated in FIG. 1.

Referring now to FIGS. 1-7, a lamp connector 10 according to an embodiment of the present invention is now described in greater detail. The lamp connector 10 may include a base member 12, a top member 1, and connector members 9. The connector members 9 may be connected to each of the base member 12 and the top member 1 to connect the base member 12 and the top member 1 to one another. For example, and perhaps as best illustrated in FIG. 1, the base member 12 and the top member 1 may be connected to one another using the connector members 9 so that the base member 12 may be rotated to accommodate a lamp connecting member 11.

The lamp connecting member 11 may, for example, be an end portion of a light pole. Those skilled in the art will appreciate that there are several different types of light poles. The lamp connecting member 11 that is illustrated in the appended figures are those that extend generally horizontal with respect to the surface upon which light is to be emitted. Those skilled in the art will appreciate that the lamp connector 10 according to the embodiments of the present invention is suited to be used with any lamp connecting member 11 that may have any configuration or orientation. The lamp connector 10 according to an embodiment of the present invention may be adapted to be connected to the lamp connecting member 11. Those skilled in the art will appreciate that the lamp connecting member 11 may be any structural member that may be adapted to receive a lamp, i.e., a street lamp that is preferably adapted to illuminate a surface. Typically, lamp connecting members are elevated so that light emitted from a street lamp (or other lamp) may be emitted to cover a greater surface area than a lamp that is mounted at a lower elevation. Those skilled in the art will appreciate, however, that mounting a street lamp at an elevation that may be considered too high may not be optimal for light emission and reflection on a surface thereunder.

The lamp connector 10 according to an embodiment of the present invention advantageously allows for existing lamp connecting members to be used in connection with installation of various designs of street lamps. More specifically, as street lamps have advanced with technology, there has not been as much advancement in lamp connecting member. Accordingly, it is common for a newly designed street lamp to be connected to an existing lamp connecting member. Therefore, the lamp connector 10 according to embodiments of the present invention advantageously eliminates waste associated with replacing existing lamp connecting members to accommodate new street lamps. The lamp connector 10 according to embodiments of the present invention also advantageously reduces manufacturing costs of newly designed street lamps so that street lamps may be universally connected to any type of existing lamp connecting member. Those skilled in the art will appreciate that any type of lamp connecting member 11 may be used in connection with the lamp connector 10 of the present invention. The lamp connector 10 according to an embodiment of the present invention may advantageously accommodate lamp connecting members having various sizes. More specifically, those skilled in the art will appreciate that the lamp connector 10 may facilitate the new installation of the lamp connector 10 onto a lamp connecting member 11 of a variety of sizes, including sizes as dictated by industry standards. Accordingly, various aspects of the lamp connector 10 may be configured to conform to sizes as dictated by industry standards. Additionally, it will be appreciated that the installation of the lamp connector 10 on the lamp connecting member 11 provides an attachment of sufficient strength and resiliency as is required in the field for all intended uses.

Figure 7:
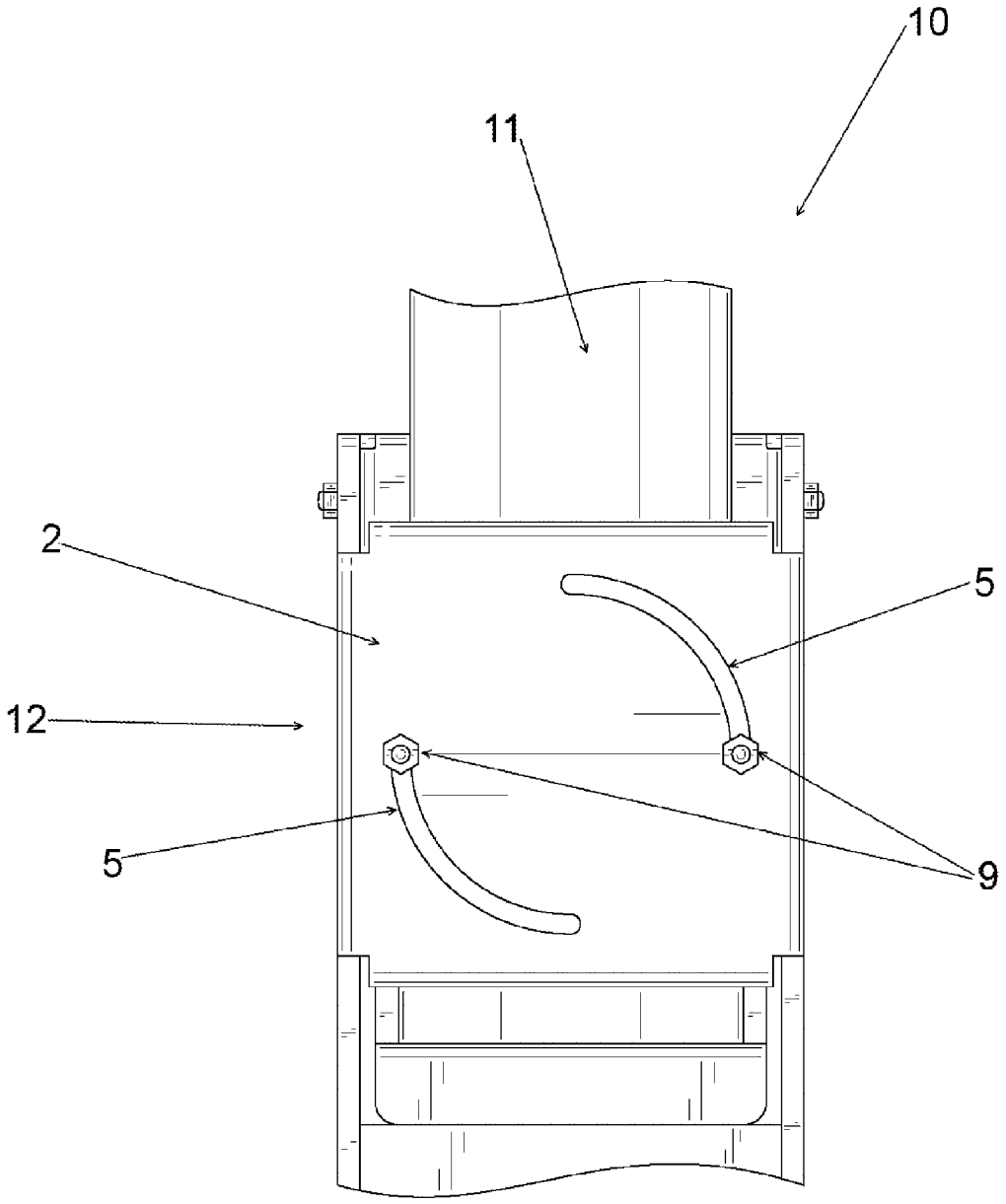
FIG. 7 is a bottom plan view of the lamp connector illustrated in FIG. 1.

Referring now additionally to FIG. 1 and FIG. 7, additional details of the base member of the lamp connector 10 according to embodiments of the present invention are now described in greater detail. More specifically, the base member 12 may include a bottom portion 2 having arcuate passageways 5 formed therein. As perhaps best illustrated in FIG. 7, the arcuate passageways 5 formed in the bottom portion 2 of the base member 12 are illustratively configured to be symmetrical to one another about a point of reference of the bottom portion 2. Specifically, the arcuate passageways 5 may be symmetrical with respect to a line defined across the bottom portion 2 positioned intermediately between the arcuate passageways 5. This advantageously allows for rotation of the base member 12 with respect to the top member 1, as will be discussed in greater detail below.

Although the arcuate passageways 5 are illustrated as having rounded ends, those skilled in the art will appreciate that the arcuate passageways may have any shape. The arcuate passageways 5 formed in the bottom portion 2 of the base member 12 may also be threaded. Those skilled in the art would appreciate that threaded arcuate passageways 5 would enable a threaded connector member 9 to better grip the threaded arcuate passageways 5 and therefore enable a tighter and more secure connection between the base member 12 and the top member 1.

Further, those skilled in the art will appreciate that although the appended figures illustrate that the bottom portion 2 of the base member 12 may include a pair of arcuate passageways, the invention according to embodiments of the present invention contemplates that more than a pair of arcuate passageways may be provided while still accomplishing the goals, features and objectives of the present invention. More specifically, it is contemplated that three or four arcuate passageways for example may be provided to achieve the goals of the present invention. The invention also contemplates that the bottom portion 2 of the base member 12 may include a single pathway in the shape of a circle, where the connector members connect to the pathway. Regardless of the number of passageways formed in the bottom portion of the base member, the passageways are preferably oriented in a symmetrical manner so as to allow rotation of the base member.

Additionally, in some embodiments, the arcuate passageways 5 may be replaced by discrete vias, or passageways, configured to permit the connector members 9 to be positioned therethrough. Moreover, in such embodiments, the discrete vias may be positioned in the bottom portion 2 so as to selectively position the base member 12 at an orientation relative to the lamp connecting member 11. In such embodiments, the base member 12 would not be able to rotate with respect to the lamp connecting member 11 while a connector member 9 is positioned through the discrete via. Any number of discrete vias may be included. Additionally, not every discrete via may have a connector member 9 positioned therethrough. Instead, the connector members 9 may be positioned through selected discrete vias dependent upon characteristics of the lamp connector member 11, such as, but not limited to, its diameter, the geometric configuration, and its orientation, resulting in a selection of an orientation of the base member 12 with respect to the lamp connecting member 11, as will be discussed in greater detail hereinbelow.

Figure 4:
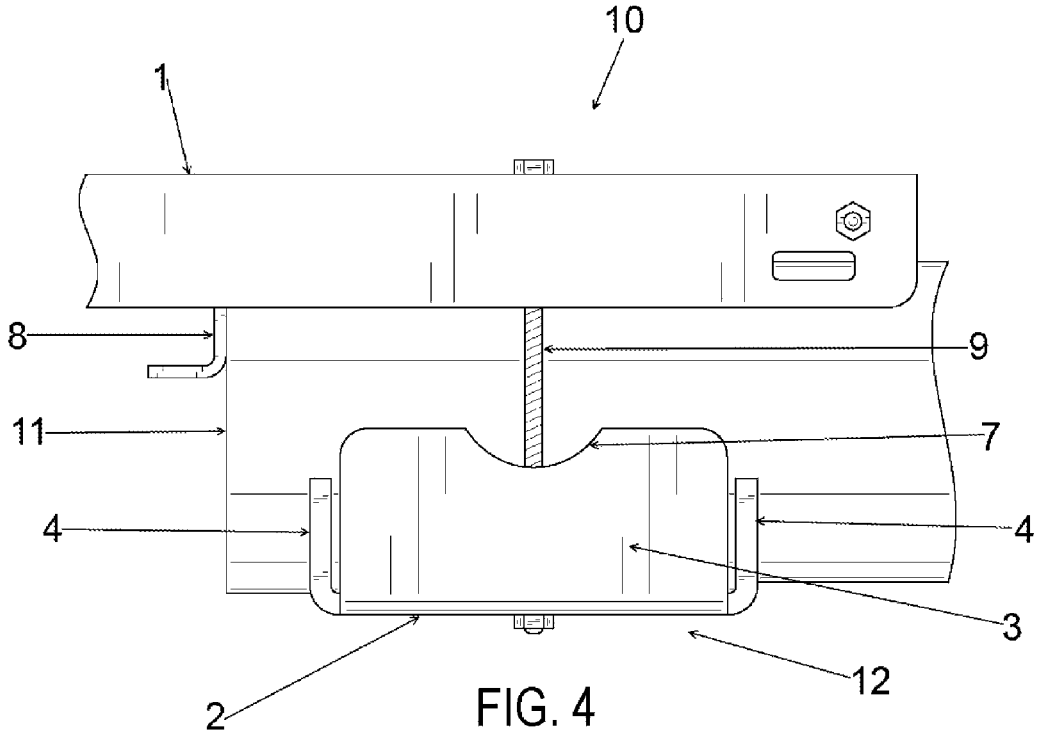
FIGS. 4-5 are side elevation views of the lamp connector illustrated in FIG. 1.
Figure 5:
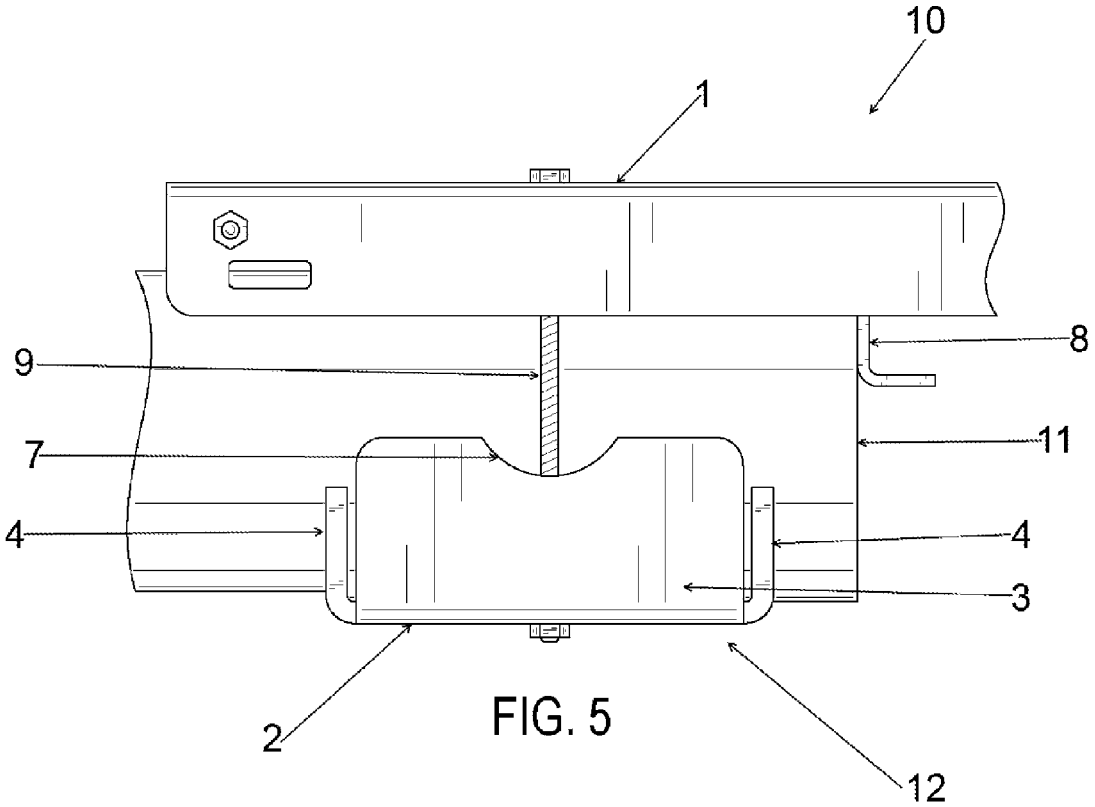
Figure 6:
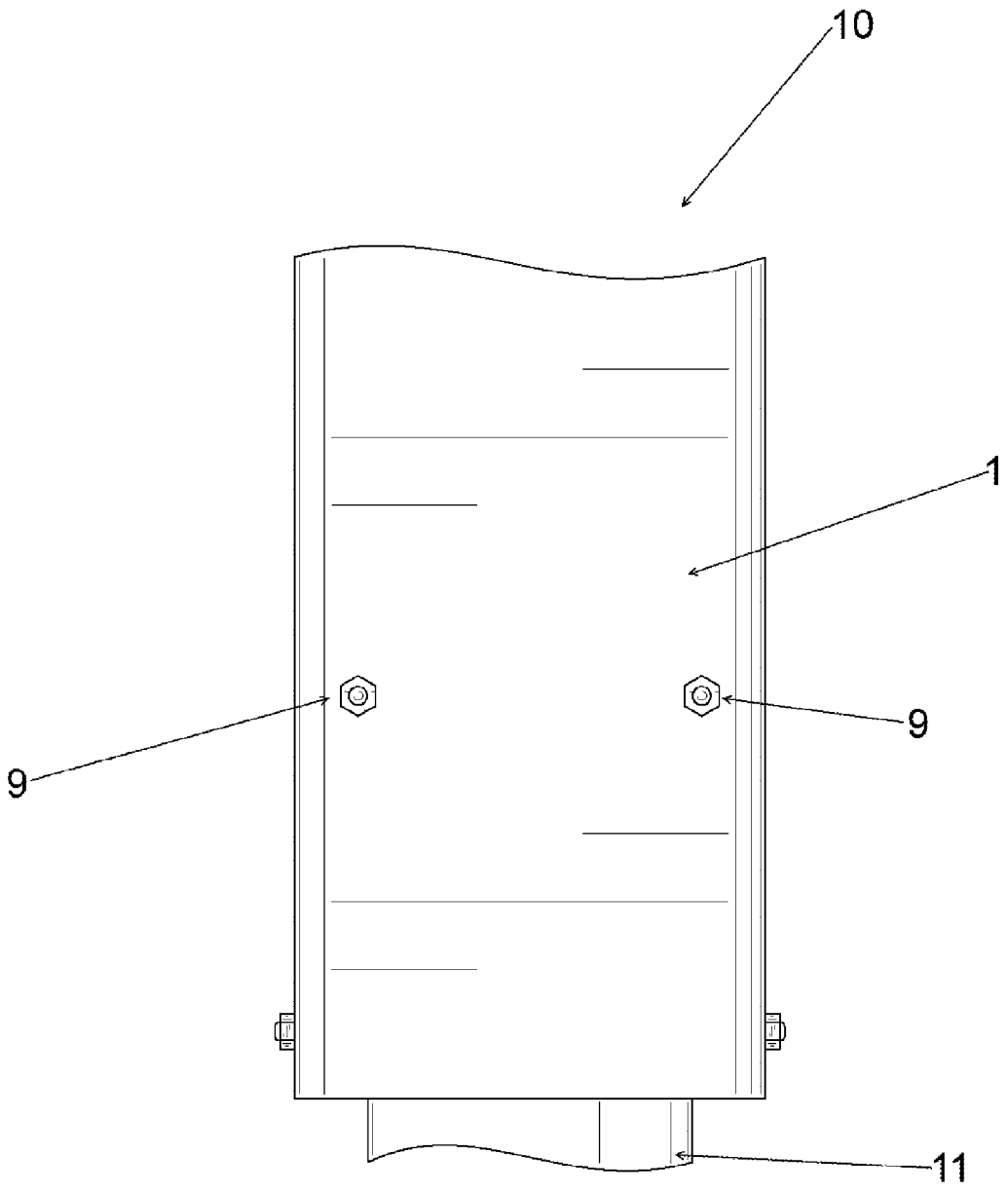
FIG. 6 is a top plan view of the lamp connector illustrated in FIG. 1.

As perhaps best illustrated in FIGS. 4-5, the base member 12 may include a first pair of opposing sidewall members 4 that extend upwardly from the bottom portion 2, and a second pair of opposing sidewall members 3 that also extend upwardly from the bottom portion 2. The first and second pairs of opposing sidewalls 4, 3 may be generally rectangular-shaped and extend from the edges of the bottom portion 2. A skilled artisan would appreciate that the shape of the sidewalls 4 and 3 may be modified to any shape known in the art while still accomplishing the aims, goals and features of the present invention, without departing from the scope of the invention. The bottom portion 2 and the first and second pair of opposing sidewalls 4, 3 may be integrally formed as a monolithic unit. The invention also contemplates that the first and second pair of opposing sidewalls 4, 3 may be welded to the bottom portion 2 of the base member 12. In FIG. 1, the bottom portion 2 of the base member 12 is illustrated with a U-shaped groove 19 between the first and second pair of opposing sidewalls 4, 3 respectively. A skilled artisan would appreciate that the presence of the U-shaped groove 19 may enable a reduction in manufacturing costs as the lamp connector 10 would require less material to manufacture. Those skilled in the art, however, should not limit the invention to requiring a U-shape groove 19 between the first and second pair of opposing sidewalls 4, 3, but instead should understand that the U-shaped groove is simply an example of the configuration of a space that may be positioned between the first and the second pair of opposing sidewalls 4, 3. The present invention contemplates that no space may be provided between the first and second pair of opposing sidewalls 4, 3 in other embodiments of the present invention.

The top portion of each of the first and second pairs of opposing sidewall members 4, 3 may each have a cutaway portion 7, 6, respectively, formed therein. More specifically, each of the opposing sidewall members 4, 3 may have a first cutaway portion 7 and a second cutaway portion 6. Each of the first and second cutaway portions 7, 6 of the first and second pairs of opposing sidewall members 4, 3 may be configured to have a selected geometric configuration. The geometric configuration of the first and second cutaway portions 7, 6 may be configured to conform to a geometric configuration of the lamp connecting member 11. In the present embodiment, each of the first and second cutaway portions 7, 6 may have a generally arcuate configuration. Where, as in the present embodiment, the first and second cutaway portions 7, 6 are generally arcuate, they may define a radius.

The first cutaway portion 7 formed in the top portion of the first pair of opposing sidewalls 4 may have a first radius, and the second cutaway portion 6 formed in the top portion of the second pair of opposing sidewalls 3 may have a second radius. As illustrated in FIG. 1, the first radius and the second radius may be different. This advantageously allows for the lamp connector 10 according to embodiments of the present invention to accommodate lamp connecting members 11 having different diameters. As will be discussed in greater detail below, the base member 12 may readily be rotated so as to align either the first pair of opposing sidewalls 4 having the first cutaway portion 7 formed therein with the first radius with the lamp connecting member 11 or the second pair of opposing sidewalls 3 having the cutaway portion 6 formed therein with the second radius. This may depend, of course, on the diameter of the lamp connecting member 11. Accordingly, the first and second cutaway portion 7, 6 of each of the first pair and second pair of opposing sidewalls 4, 3 respectively, is preferably formed to fit the diameter of a lamp connecting member 11.

This configuration, for example, advantageously allows for the lamp connector 10 of the present invention to be readily used to connect the lamp to lamp connecting members 11 having various diameters. Accordingly, many different configurations of base members 12 may be manufactured to accommodate several different sizes of lamp connecting members 11 as well as different shapes of lamp connecting members. Those skilled in the art will appreciate that the first and second cutaway portion 7, 6 of the base member 12, although illustrated as having an arcuate shape, may have any shape. For example, it is contemplated that the lamp connecting member 11 may have a polygonal shape. Accordingly, the first and second cutaway portions 7, 6 of the base member 12 may be provided with various sized polygonal shapes. Sizing the first and second cutaway portions 7, 6 of the base member 12 as desired advantageously decreases manufacturing costs of the lamp connector 10, as well as installation costs of lamps in general. More specifically, in order to accommodate for various sized lamp connecting members 11, only the base member may need to be manufactured. In other words, there is only a need to manufacture one type of top member 1 where is various base members 12 may be manufactured having various sizes first and second cutaway portions 7, 6.

In some embodiments, the base member 12 of the lamp connector 10 may include more than two pairs of opposing sidewalls. For example, the bottom portion 2 may be shaped as a hexagon or an octagon, which can support three or four pairs of opposing sidewalls, respectively. The sidewalls may extend from the edges of the bottom portion in a manner similar to the illustration of FIG. 1. In yet another embodiment, the bottom portion 2 of the lamp connector 10 may be shaped as a circle. A circular bottom portion may include 2 or more pairs of opposing sidewalls. A skilled artisan would appreciate that the number of sidewall pairs on a circular bottom portion would be determined by the size of the lamp connecting members 11 for which the bottom portion is designed and the area of the bottom portion.

In FIG. 1, the first and second cutaway portions 7, 6 are illustrated with a crescent-shaped cutaway portion. In another embodiment, and as briefly discussed above, the first and second cutaway portions 7, 6 may have a rectangular shape to fit a lamp connecting member with rectangular sides. A skilled artisan would appreciate that the shape of the first and second cutaway portions 7, 6, may be modified to any shape known in the art, to conform to the shape of a particular lamp connecting member 11. The first and second cutaway portions 7, 6 may each have a different radius or size or shape. Therefore the first cutaway portion 7 may have an arcuate shape and the cutaway portion 6 may have a rectangular shape. The first and second cutaway portions 7, 6 of sidewalls 4, 3, respectively, may fit lamp connecting members 11 of different dimensions. Moreover, where the base member 12 includes more than two pairs of opposing sidewalls, the cutaway portions of those additional pairs of opposing sidewalls may be configured to fit lamp connecting members 11 of dimensions different than those for which the first and second cutaway portions 7, 6 of the first and second pairs of opposing sidewalls 4, 3 are configured to conform to.

As indicated above, the base member 12 may be configured to be rotatable with respect to the top member 1 so that a user may select between engagement with at least the first pair of sidewalls 3 or the second pair sidewalls 4 with the lamp connecting member 11. More specifically, in some embodiments, during installation, the connector members 9 of the lamp connector 10 may be transitionable between a detached position and an attached position. In the detached position, the connector members 9 may be detached from the base member 12 so as to permit the base member 12 to be transitioned to a disengaged position. The disengaged position may be defined as the base member 12 being extended from the top member 1, where the base member 12 may be able to rotate freely. In other words, the disengaged position may allow for the first and second cutaway portions 7, 6 of each of the first and second pairs of opposing sidewalls 4, 3 of the base member 12 to be spaced apart from the lamp connecting member 11. A user installing a a lamp connector 10 onto a lamp connecting member 11 may selectively rotate the base member 12 with respect to a lamp connecting member 11 so that at least one of the first and second cutaway portions 7, 6 of the first or second pair of opposing walls 4, 3, respectively, may be aligned with the frontal sidewall 14 of the top member 1 so that the lamp connector 10 may be readily engaged to the lamp connecting member.

Upon transitioning the connector members 9 to the detached state, space between the base member 12 and the top member 1 may be increased. Increasing the space between the base member 12 and the top member 1 advantageously allows for the lamp connector 10 according to an embodiment of the present invention to slidably engage a lamp connecting member 11. As illustrated, for example, in FIG. 1, a lamp connector 10 that is slidably engaged with a lamp connecting member 11 may have at least a portion of the lamp connecting member 11 positioned between the base member 12 and the top member 1. When the lamp connector 10 is initially positioned to engage the lamp connecting member 11, the connector members 9 may be positioned in a detached state and the base member 12 may be in the disengaged position. In other words, the top member 1 may, for example, rest on an upper portion of the lamp connecting member 11. In a disengaged position, the base member 12 may hang loosely below a bottom portion of the lamp connecting member 11 so that space is provided between the first and second cutaway portions 7, 6 of the sidewalls 4, 3 to allow for the cutaway portions to be readily aligned with the lamp connecting member 11 as desired.

After it is determined that the lamp connector 10 according to an embodiment of the present invention is laterally positioned at a desired location along a length of the lamp connecting member 11, the base member 12 may then be moved to the engaged position. The engaged position may be defined as the connector members 9 being moved to the attached state so that the space between the base member 12 and the top member 1 is decreased, thereby allowing the base member 12 to be in contact the lamp connecting member 11. The base member 12 may contact the lamp connecting member 11 by having a first and second cutaway portion 7, 6 of at least one of the first or second pair of opposing sidewalls 4, 3, respectively, in contact with the lamp connecting member 11. When completely transitioned to the attached state, the connector members 9 may cause the lamp connector 10 to be securely attached to the lamp connecting member 11.

The means or method by which the connector members 9 are transitioned between the attached and detached state may depend upon the nature of the connector members 9. In some embodiments, the connector members 9 may be threaded members. More specifically, the connector members 9 may be a nut-and-bolt device, whereby the nut may be configured to rotatably couple to the bolt and translate along the length of the bolt by rotating. Additionally, the connection between the lamp connector 10 and a lamp connecting member 11 may be a result of force exerted by the nut on at least one of the base member 12 and the top member 1 as a result of longitudinal translation along the bolt. It is contemplated and included within the scope of the invention that any suitable connector member 9 may be employed so as to facilitate the connection between the lamp connector 10 and the lamp connecting member 11.

As perhaps best illustrated in FIG. 1, the top member 1 may include a plurality of connector member passageways 16 formed therein to receive the connector members 9 and permit them to pass therethrough. More specifically, the connector member passageways 16 may extend through a portion of the upper surface of the top member 1 and a planar face 1*a* at the bottom surface of the top member 1. The top member 1 may further include an upper surface and top member sidewalls 17 that extend downwardly therefrom. The top member sidewalls 17 may be configured to be opposing one another, and may extend generally parallel to one another. Those skilled in the art will appreciate, however, that the top member sidewalls 17 do not necessarily need to be configured parallel to one another. Instead, the top member sidewalls 17 may extend offset from one another, i.e., not parallel. Additionally, the top member 1 may further include lateral sidewalls 18. The lateral sidewalls 18 may be positioned generally opposite each other and generally between the top member sidewalls 17.

As also illustrated in FIG. 1, horizontally positioned passageway 13 may be formed in each of the top member sidewalls 17 of the top member 1. The horizontally positioned passageways 13 may extend through the top member sidewalls 17 and the lateral sidewalls 18. In FIG. 1, the horizontally positioned passageway 13 is illustrated with a bolt (secured to the top member 1 by a nut) inserted into the horizontally positioned passageway 13. The top member 1 may also include a main body member 15 that is pivotally connected to the top member 1 so as to be positioned between the top member sidewalls 17. The pivotal connection between the main body member 15 and the top member 1 may facilitate the secure fitting of the lamp connecting member 11 between the planar face member 1*a* and at least one of the cutaway portions 7, 6 of the base member 12, as was described hereinabove.

More specifically, the main body member 15 may define the planar face member 1*a* of the top member 1 that is opposite the base member 12, a frontal sidewall 14, and lateral sidewalls 18 extending upwardly therefrom and adjacent to the frontal sidewall 14. The planar face member 1*a* may additionally include a movement restriction member 8 that extends downwardly from the main body member 15 at an end of the main body member 15 that is generally opposite the frontal sidewall 14. The movement restriction member 8 may, for example, have an L-shape extending downwardly from the main body member. The movement restriction member 8 may restrict the longitudinal movement of the lamp connecting member 11. A skilled artisan would appreciate that the shape of the movement restriction member is not limited to an L-shaped portion. The movement restriction member 8 may utilize any shape known in the art that prevents the lamp connecting member 11 from sliding when connected to the lamp connector 10.

As described hereinabove, the main body member 15 may have connecting member passageways 16 formed therein. The connecting member passageways 16 may extend from the top member 1, through the planar face member 1*a* and are preferably aligned with the arcuate passageways 5 formed in the bottom portion 2 of the base member 12.

The connector members 9 may connect the top member 1 to the base member 12 as described hereinabove. The connector member 9 may, for example, be a bolt. Additionally, the connector member 9 may be threaded. The connector member 9 according to an embodiment of the present invention may be adapted to connect the top member 1 to the base member 12. Those skilled in the art may appreciate that the connector member 9 may be any structural member that is adapted to be inserted into the connector member passageways 16 for securing the base member 12 to the top member 1, after moving the base member 12 between the engaged position and the disengaged position. The connector member 9 may be fastened to the top member 1 and the base member 12 at either end by the use of a fastener, such as a nut.

In another embodiment of the lamp connector 10 according to the present invention, each of the arcuate passageways 5 formed in the bottom 2 of the base member 12 may be threaded. Accordingly, a threaded connector member 9 may be passed through the passageways 16 formed in the top member 1 and threadably engage threaded arcuate passageways 5 formed in the bottom 2 of the base member 12. In such an embodiment, fasteners may also be used to engage the threaded connector members 9 after they have been threadably connected to a threaded arcuate passageway 5. This advantageously enhances security of the installation of the lamp connector 10 according to embodiments of the present invention to the lamp connecting member 11.

The connector member 9 may extend from the top member 1, through the connector member passageways 16, and continue through the planar face member 1*a* to the arcuate passageways 5 formed in the bottom portion 2 of the base member 12. Those skilled in the art will appreciate that the lamp connector 10 may include a pair of connector members 9. The pair of connector members 9 may extend downwardly from the top member 1 into the arcuate passageways 5 of the bottom portion 2 of the base member 12. In some embodiments, the pair of connector members may extend from the top member 1 and pass through or, alternatively, engage a pair of arcuate passageways in the bottom portion 2 of the base member 12. As described hereinabove, the connector members 9 may secure the base member 12 and the top member 1 to overlie the lamp connecting member 11. A skilled artisan would appreciate that the lamp connector 10 may utilize a single connector member or any number of connector members to connect the base member 12 to the top member 1.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. A lamp connector comprising:

a base member;

a top member; and connector members having portions connected to each of the base member and the top member to connect the base member and the top member to one another;

wherein the base member comprises:

a bottom portion having arcuate passageways formed therein, a first pair of opposing sidewall members that extend upwardly from the bottom portion, and a second pair of opposing sidewall members that extend upwardly from the bottom portion, wherein a top portion of each of the first pair of opposing sidewall members has a first cutaway portion having a first radius, wherein a top portion of each of the second pair of opposing sidewall members has a second cutaway portion having a second radius, wherein the first radius and the second radius are different, wherein the cutaway portion of each of the first pair and the second pair of opposing sidewalls is formed to fit the diameter of a lamp connecting member; and wherein the base member is selectively rotatable with respect to the top member so as to enable engagement between one of the first pair of sidewalls and the second pair of sidewalls with the lamp connecting member.

2. The lamp connector of claim 1 wherein the top member has passageways formed therein to receive the connector members.

3. The lamp connector of claim 1 wherein the connector members are a pair of connector members; wherein the arcuate passageways are a pair of arcuate passageways; and wherein the pair of connector members engages the pair of arcuate passageways to secure the lamp connecting member between the base member and the top member.

4. The lamp connector of claim 1 wherein the arcuate passageways of the base member are symmetrically formed.

5. The lamp connector of claim 1 wherein the arcuate passageways of the base member are threaded.

6. The lamp connector of claim 1 wherein the connector members are bolts and are movable between a detached position and an attached position; wherein the detached position is defined as allowing the base member to rotate with respect to the lamp connecting member; and wherein the attached position is defined as the cutaway portion of at least one of the first and second pair of opposing sidewalls being tightened to the lamp connecting member.

7. The lamp connector of claim 1 wherein the base member and the first and second opposing sidewalls are integrally formed as a monolithic unit.

8. The lamp connector of claim 1 wherein the first and second opposing sidewalls are welded to the base member.

9. The lamp connector of claim 1 wherein top member includes a movement restriction member that has an L-shaped portion to be positioned to restrict movement of the lamp connecting member.

10. A lamp connector comprising:

a base member;

a top member; and connector members having portions connected to each of the base member and the top member to connect the base member and the top member to one another;

wherein the base member comprises a bottom portion having arcuate passageways formed therein, a first pair of opposing sidewall members that extend upwardly from the bottom portion, and a second pair of opposing sidewall members that extend upwardly from the bottom portion, wherein a top portion of each of the first pair of opposing sidewall members has a first cutaway portion having a first radius, wherein a top portion of each of the second pair of opposing sidewall members has a second cutaway portion having a second radius, wherein the first radius and the second radius are different;

wherein the cutaway portion of each of the first pair and the second pair of opposing sidewalls is formed to fit the diameter of a lamp connecting member;

wherein the base member is selectively rotatable with respect to the top member so as to enable engagement between one of the first pair of sidewalls and the second pair of sidewalls with the lamp connecting member;

wherein the arcuate passageways are formed therein to receive the connector members;

wherein the connector members are a pair of connector members;

wherein the arcuate passageways are a pair of arcuate passageways; and wherein the pair of connector members engages the pair of arcuate passageways to secure the lamp connecting member between the base member and the top member.

11. The lamp connector of claim 10 wherein the top member has passageways formed therein to receive the connector members.

12. The lamp connector of claim 10 wherein the arcuate passageways of the base member are symmetrically formed.

13. The lamp connector of claim 10 wherein the connectors are bolts and are movable between detached positions and attached positions; wherein the detached position is defined as allowing the base member to freely rotate, and the attached position is defined as the base member being tightened to the lamp connecting member.

14. The lamp connector of claim 10 wherein the arcuate passageways of the base member are threaded.

15. The lamp connector of claim 10 wherein the base member and sidewalls are integrally formed as a monolithic unit.

16. The lamp connector of claim 10 wherein top member includes a movement restriction member that has an L-shaped portion to be positioned to restrict movement of the lamp connecting member.

17. A lamp connector comprising:

a base member;

a top member; and a pair of connector members each having portions connected to each of the base member and the top member to connect the base member and the top member to one another;

wherein the base member comprises a bottom portion having a pair of symmetrically formed arcuate passageways formed therein, a first pair of opposing sidewall members that extend upwardly from the bottom portion, and a second pair of opposing sidewall members that extend upwardly from the bottom portion, wherein a top portion of each of the first pair of opposing sidewall members has a cutaway portion having a first radius, wherein a top portion of each of the second pair of opposing sidewall members has a cutaway portion having a second radius, wherein the first radius and the second radius are different, wherein the cutaway portion of each of the first pair and the second pair of opposing sidewalls is formed to fit the diameter of a lamp connecting member, wherein the base member and the first and second pair of opposing sidewalls are integrally formed as a monolithic unit; and wherein the base member is selectively rotatable with respect to the top member so as to enable engagement between one of the first pair of sidewalls and the second pair of sidewalls with the lamp connecting member;

wherein the pair of connector members engages the pair of arcuate passageways to secure the base member to the top member;

wherein the top member includes passageways formed therein to receive the connector members;

wherein the top member connects to a lamp; and wherein the lamp further comprises a light source that is a light-emitting diode.

18. The lamp connector of claim 17 wherein the connectors are bolts and are movable between detached positions and attached positions;

wherein the detached position is defined as allowing the base member to freely rotate, and the attached position is defined as the base member being tightened to the lamp connecting member.

* * * * *